US005364038A

United States Patent [19]

Prew

[11] Patent Number: 5,364,038

[45] Date of Patent: Nov. 15, 1994

[54] SCREENLESS HAMMERMILL

[75] Inventor: Stanley R. Prew, Williamsport, Pa.

[73] Assignee: Andritz Sprout-Bauer, Inc., Muncy, Pa.

[21] Appl. No.: 60,319

[22] Filed: May 11, 1993

[51] Int. Cl.[5] ..... B02C 13/04

[52] U.S. Cl. ..... 241/189.1; 241/194; 241/285.1

[58] Field of Search ..... 241/189.1, 190, 194, 241/196, 285.1, 88.4

[56] References Cited

U.S. PATENT DOCUMENTS

| | | | |
|---|---|---|---|
| 1,772,533 | 8/1930 | Battey | 241/190 |
| 1,936,025 | 11/1933 | Mahaffey | 241/190 |
| 3,677,478 | 7/1972 | Schutte | 241/82 |
| 4,907,750 | 3/1990 | Seifert | 241/73 |
| 5,062,575 | 11/1991 | Barnabie et al. | 241/73 |

*Primary Examiner*—Timothy V. Eley
*Assistant Examiner*—John M. Husar
*Attorney, Agent, or Firm*—Chilton, Alix & Van Kirk

[57] ABSTRACT

A hammermill (10) comprises a casing (12) having a longitudinal axis (18) and a sidewall (20) such that an enclosed grinding space (24) is defined within the casing. A rotor assembly (26) is situated within the casing for rotation about the axis, and includes hammer elements each having a radially outer tip (34) which defines a hammer rotation diameter. At least one grinding plate at the inside of the sidewall defines a grinding surface (38) in the grinding space having a radius of curvature centered on the axis, a length dimension parallel to the axis, and a width dimension defined by an arc about the axis. The grinding plate has a plurality of spaced apart edges such that each hammer tip (34) passes along the width dimension of the grinding plate with a clearance from the edges which defines a grinding gap. The sidewall other than at the grinding plate has a non-uniform curvature which defines a non-uniform clearance from the hammer rotation diameter that is greater than the grinding gap clearance. The non-uniform curvature includes at least one sidewall portion having a radius of curvature less than that of the grinding surface.

25 Claims, 6 Drawing Sheets

SCREENLESS HAMMERMILL

BACKGROUND OF THE INVENTION

The present invention relates to impact grinders, hammermills or the like, and in particular, to hammermills for grinding corn and similar friable material.

Typical hammermills for grinding friable material such as corn or the like, impact the material with rotating hammers and control particle size by the opening size of a screen against which the hammers force the material. Throughput rate and hammer-to-screen clearance have an effect on hammermill efficiency. It is commonly accepted that for a given product such as shelled corn, an optimum hammer tip speed of, for example, 17,000 feet per minute (f/m) must be achieved for the most efficient operation. Most commercially available hammermills represent a compromise in tip speed in order to grind different products reasonably well.

In the article, "Increasing Hammermill Efficiency: A Need in an Era of Rising Power Costs", published in December 1981 by the Sprout-Waldron Division of Koppers Company, Inc. the present inventor describes the operation of a conventional hammermill for grain processing, whereby the material is ultimately forced through screen perforations by the action of the rotating hammers. The cost for manufacture of the screen component of a hammermill, and the need for frequent replacement of the screen, represent a significant initial and ongoing financial outlay.

SUMMARY OF THE INVENTION

It is an object of the present invention to provide a hammermill usable for the impact grinding of grain and other friable material, without the necessity for a perforated screen, yet retaining the ability to adjust particle size.

This object is accomplished with the invention, by providing a casing having an inlet end, a discharge end, and a longitudinal axis passing between the inlet and the discharge ends. A side wall substantially encapsulates the axis between the inlet and discharge ends, such that an enclosed grinding space is defined within the casing. A rotor assembly is situated within the casing for rotation about the axis, and includes a rotatable shaft on the axis, support means extending radially from the shaft for co-rotation therewith, and hammer elements attached to the support means. The outer tips of the hammer elements define a hammer rotation diameter. At least one grinding plate is situated at the inside of the side wall for defining a grinding surface in the grinding space, with a radius of curvature centered on the axis. The grinding surface has a length dimension parallel to the axis, and a width dimension defined by an arc of less than about 90 degrees about the axis. The grinding plate is arranged such that each hammer tip passes along the width dimension of the grinding plate with a clearance in the range of about 0.03 to 1.5 inch (0.07 to 3.8 cm), thereby defining a grinding gap. The side walls other than at the grinding plate have a non uniform curvature which defines a non-uniform clearance from the hammer rotation diameter, that is greater than the grinding gap clearance. The non-uniform curvature includes at least one side wall portion having a radius of curvature less than that of the grinding surface. The grinding surface is preferably in the form of a plurality of alternating bars and grooves that extend parallel to the axis and are spaced apart in the width dimension. The grinding gap is adjustable, e.g., by movement of the grinding plates towards and away from the axis.

Thus, the hammermill according to the present invention, uses no screens, but rather utilizes hammer to grinding-surface clearance to control particle size.

Another difference relative to conventional hammermills, is the shape of the overall casing side wall. The casing is shaped to reduce the velocity of the particles, before they re-enter the grinding zone. If the particle velocity remains high, too little size reduction is achieved because the effective tip speed is too low. At the present time, the inventor favors an "exploded triangle" side wall as viewed in cross section, thereby defining three lobed regions at which the clearance from the tips of the hammer elements is greatest, but where the radius of curvature of the side wall, is minimized, i.e., in any event smaller than the radius of curvature of the grinding surface. This shape has been found to be quite effective in reducing the particle velocity as the particles emerge from the grinding zone, where the grinding gap (i.e., clearance from the hammer tips), is a minimum. By providing relatively small radii of curvature in the lobed corners on either side of the grinding surface, high drag forces are created between the side wall and the particles, causing the particles to slow down.

In another difference relative to conventional hammermills, of the type used for grain milling, considerably greater coverage of the grinding zone by the hammer elements is provided. For example, typical hammermills use flat hammers arranged four to eight in a track. Usually there is one track per inch of screen width, so that only 25% of the screen sees hammer coverage. In the preferred embodiment of the present invention, a single hammer is provided in each track, creating greater coverage in the grinding zone, e.g., at least 50% and preferably at least 66% of the grinding zone.

The flow of material in the hammermill of the present invention is axial, whereas in a typical screen type hammermill, the flow is radial. The axial transport of the material in the grinding space, is primarily due to the flow of a conveying air stream entering the grinding space at the inlet end, augmented by the air circulation arising from the operation of the rotor assembly. The material thus follows a generally helical flow path upon entering the grinding space. This path includes a series of cycles which pass through the grinding gap, followed by a reduction in velocity upon contact with the lobes, then impact by the hammer elements in the grinding space until the material re-enters the grinding zone at a location along the grinding plate that is closer to the discharge opening. In order to assure that all particles will follow at least a few cycles in the helical flow path, a plurality of substantially annular divider elements are provided at axially spaced apart locations, so as to extend radially substantially from the grinding surface in overlapping relation to the hammers. This prevents "short circuiting" of material directly to the outlet. In essence, these dividers create a plurality of sub zones through which the material passes on successive cycles along the helicle path.

BRIEF DESCRIPTION OF THE DRAWINGS

These and other objects and advantages of the invention will be described below with reference to the accompanying drawings, in which.

DESCRIPTION OF THE PREFERRED EMBODIMENT

Figure 1:
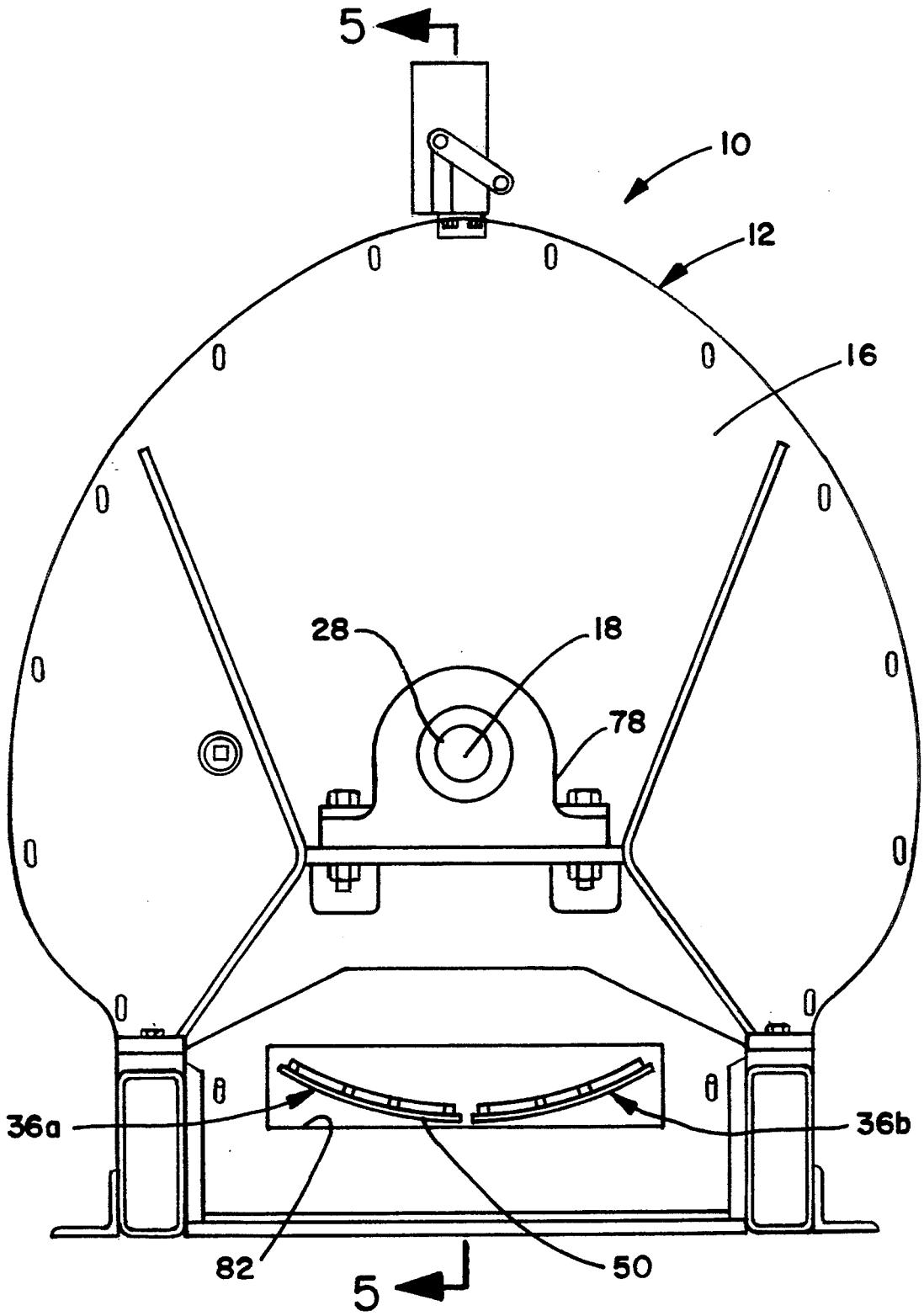
FIG. 1 is a discharge end view of the hammermill in accordance with the present invention.
Figure 2:
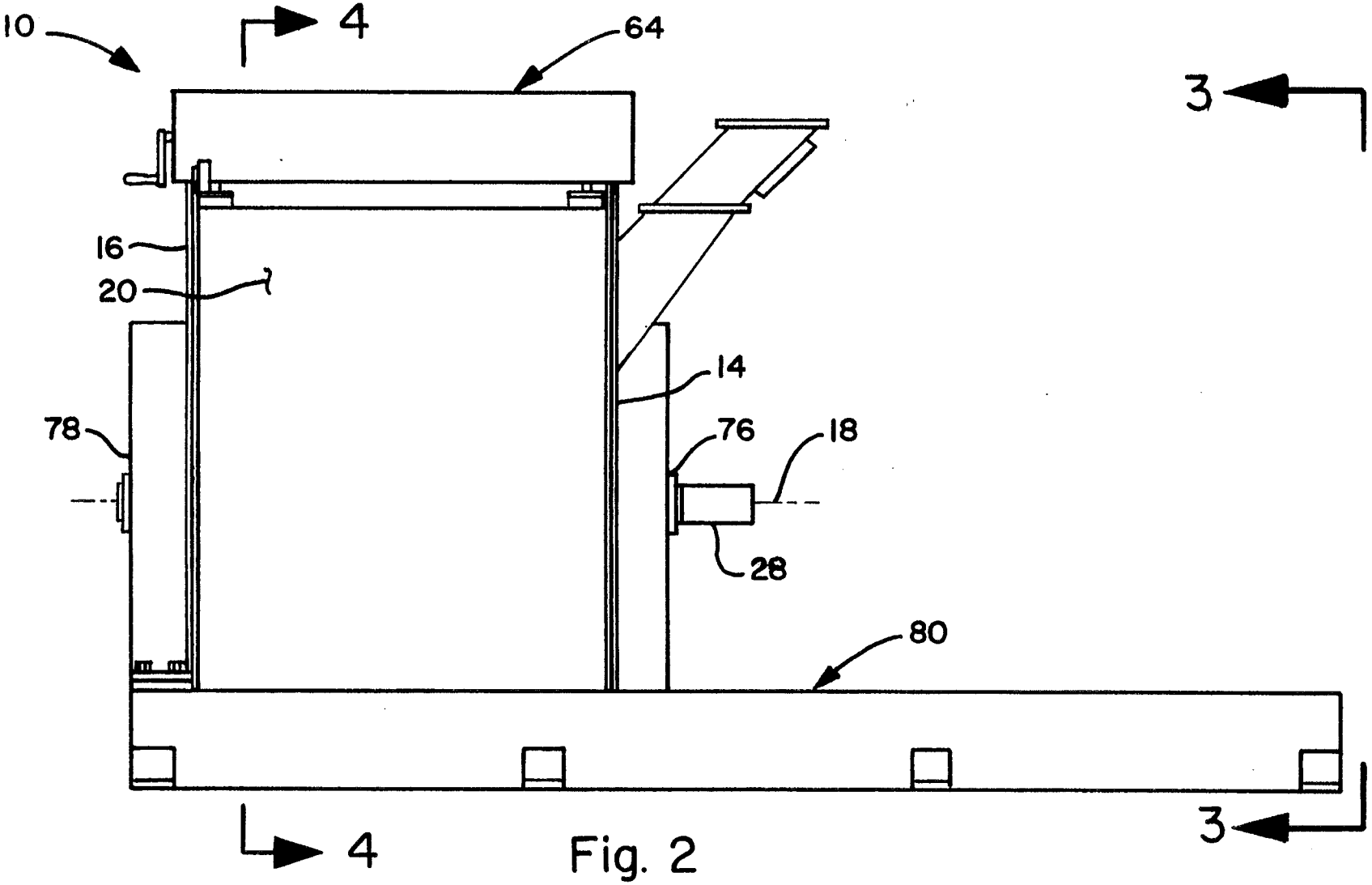
FIG. 2 is a side view of the hammermill, of FIG. 1.
Figure 3:
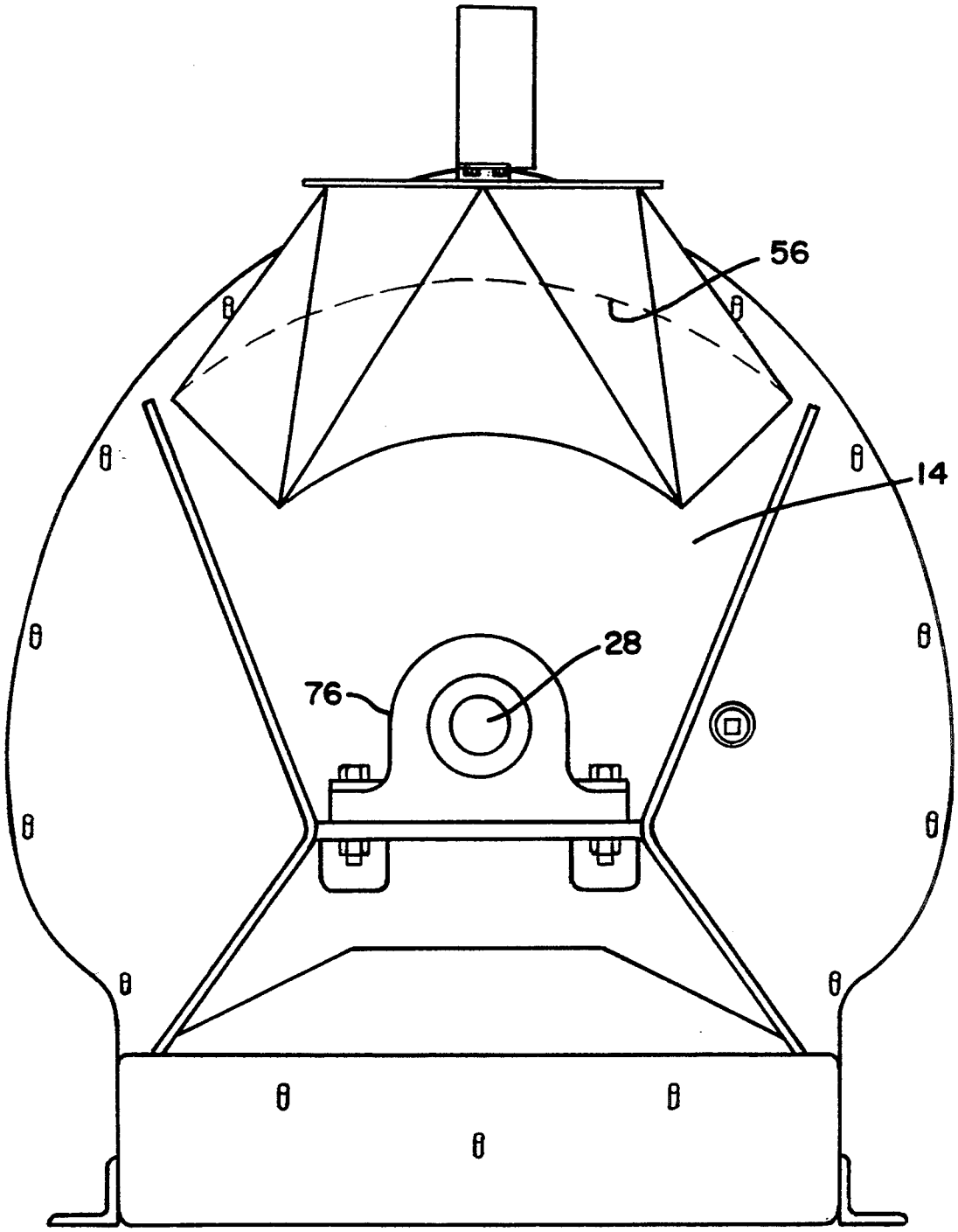
FIG. 3 is an inlet end view of the hammermill, of FIG. 2.

FIGS. 1-3 show the exterior of a hammermill in accordance with the preferred features of the present invention. The hammermill 10 has a casing 12 with an inlet end 14, a discharge end 16 and a longitudinal axis 18 passing between the inlet and discharge ends. A side wall 20 which in general appearance is somewhat tubular, substantially encapsulates the axis between the inlet and discharge ends 14,16.

Figure 4:
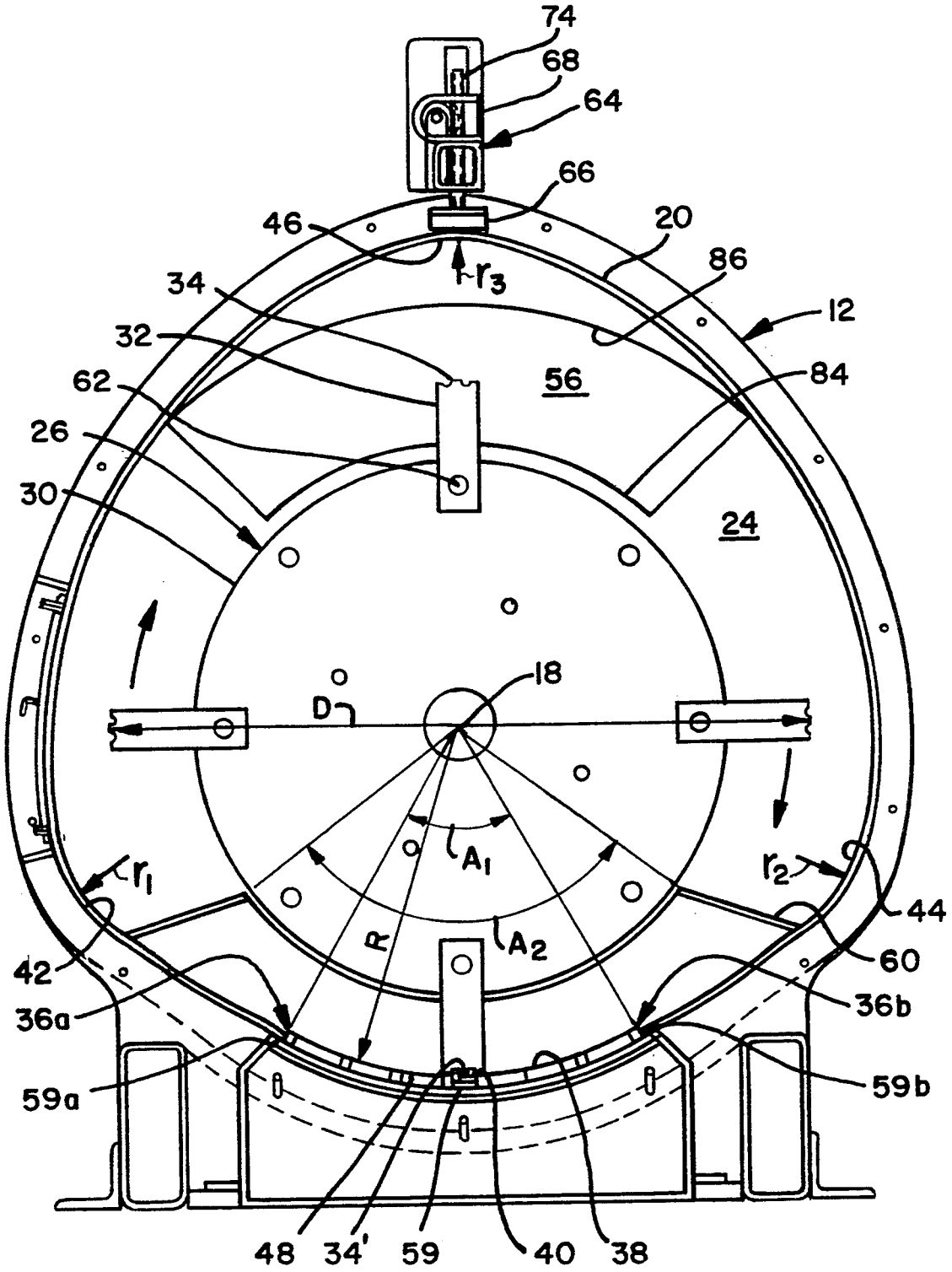
FIG. 4 is a cross section view, taken along line 4—4 of FIG. 2.
Figure 5:
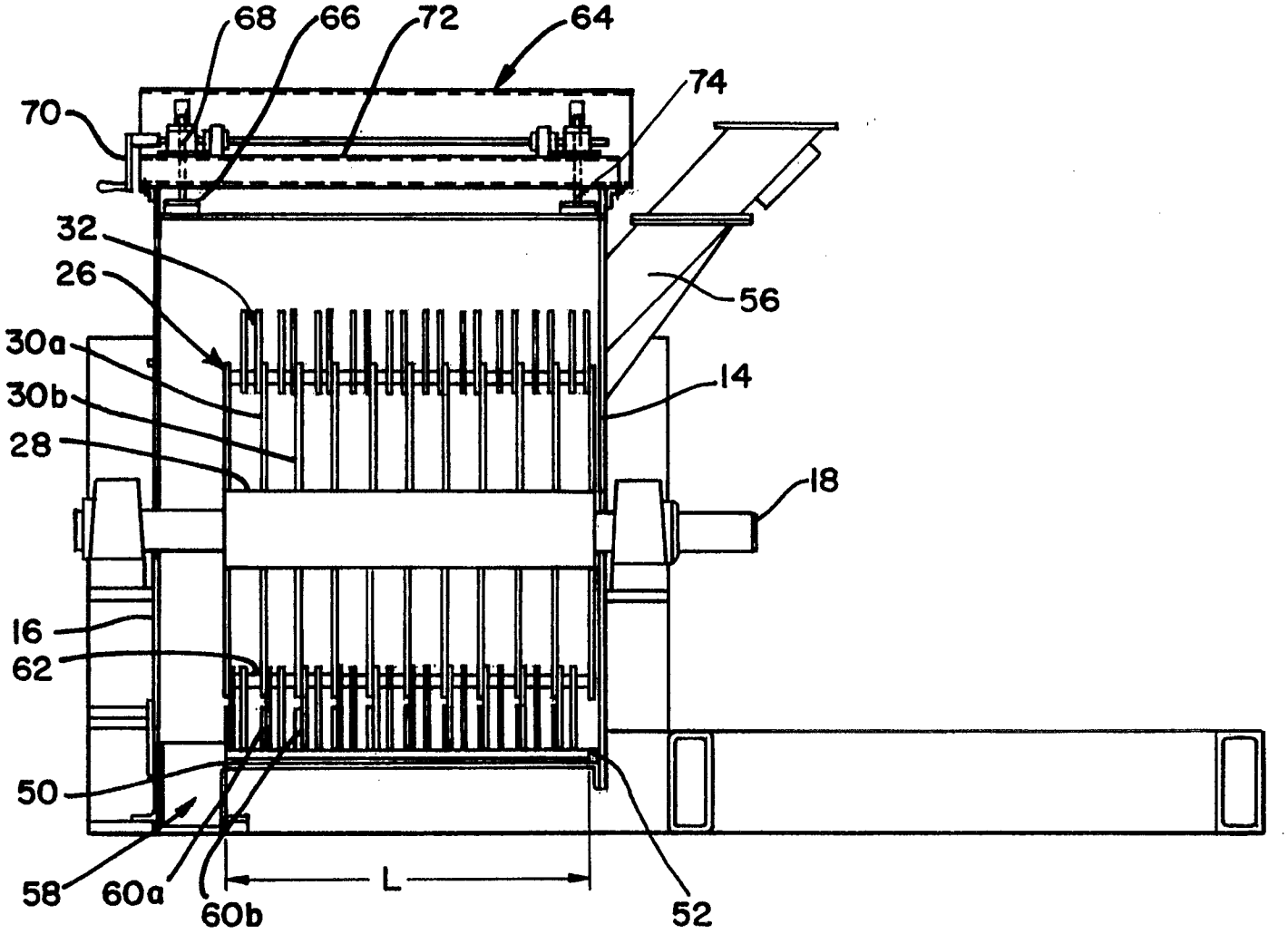
FIG. 5 is a longitudinal section view, taken along line 5—5 of FIG. 1.

The interior of the hammermill is shown in the section views of FIGS. 4 and 5. The volume 24 within the casing may be considered as a grinding space 24, where, as will be described more fully below, the friable material is reduced in size in part by impact from hammers in the relatively open portions of the grinding space 24, and also by a grinding action in the grinding zone at the lower portion of the casing.

The size reduction is accomplished by a rotor assembly 26 situated within the casing 12 for rotation about the axis 18. The rotor assembly 26 includes a rotatable shaft 28 on the axis, and support means 30 extending radially from the shaft for co-rotation therewith. Hammer elements 32 are attached to the support means 30, and extend outwardly therefrom, so that the outer tips 34 of the hammer elements define a hammer rotation diameter D centered about axis 18.

The lower portion of the casing side wall 20 in accordance with the present invention, contains at least one, and preferably two, grinding bar plates 36A,36B, which define a grinding surface 38 having a radius of curvature R centered on the axis 18. The grinding surface 38 has a length dimension L parallel to the axis, and a width dimension defined by an arc $A_1$ of less than about 90 degrees. The grinding plates 36A,36B, are arranged such that each hammer tip 34' passes along the width dimension of the grinding plate with a grinding gap or clearance 40 from the grinding surface 38, in the range of about 0.03 to 1.5 inch (0.07 to 3.8 cm). The grinding gap which extends along arc $A_1$, may be considered a grinding zone.

With the hammer elements 32 rotating at a tipspeed of, for example, 17,000 f/m through the small gap 40 in the grinding zone, at least some of the material in the grinding zone acquires a high velocity as it is propelled out of the grinding zone. For convenience, it may be assumed that in FIG. 4, the rotor assembly 26 rotates clockwise, as shown by the arrows. In an important aspect of the present invention, the side wall other than at the grinding plate or grinding surface 38, has a non-uniform curvature which defines a non-uniform clearance from the hammer rotation diameter D, that is greater than the grinding gap clearance 40. As shown in FIG. 4, the side wall region 42 adjacent the trailing edge of the grinding zone, has a radius of curvature $r_1$ which is less than the radius of curvature R of the surface 38. More generally, the side wall 20 below the elevation of the axis 18, includes the grinding surface 38 and lobed regions 42,44 on each side of the grinding surface, each lobed region having the greatest clearance but the smallest radius of curvature $r_1$, $r_2$, in the side wall below the elevation of the axis. Preferably, the side wall in diametral opposition to the grinding surface 38, defines a lobed region 46 having the largest clearance of any portion of the side wall, relative to the hammer tip diameter D. Preferably, the radius of curvature $r_3$ of region 46 is also less than that of the grinding surface 38.

The larger clearance and smaller radius of curvature in regions 42, 44 and 46 retard the velocity of the particles, so that the velocity of the hammer elements relative to the particles in the grinding space 24 outside of the grinding zone, produces particle size reduction due to impact by the hammer elements. Preferably, the overall cross-sectional shape of the side wall 20, can be considered an "exploded triangle", with the regions 42,44 and 46 representing the lobed corners, and the intervening portions of the side wall being curved rather than straight as would be found in a true triangle. The grinding surface 38 follows the arc A1 of a true circle, whereas the remainder of the side wall has a non uniform curvature which is not necessarily centered on axis 18. The slowing down force acting on the particles at the side wall regions 42,44 and 46 is in the nature of a "G" force, which has a square dependency on velocity and an inverse dependency on radius of curvature. Accordingly, as the radius of curvature decreases, the retarding force on the particles increases.

It is appreciated that "windage" from the rotating hammers tends to counteract the effect of the casing shape, and must be taken into account. Thus, for example, even though an "exploded square" cross-section can provide more lobed corners, each having a smaller radius of curvature than corresponding lobes in an "exploded triangle", the performance of the exploded square was not as good as that of the exploded triangle. This was probably because the hammer to side wall clearance was less in the short radius zones of the exploded square, than in the exploded triangle.

Another important aspect of the present invention, is the nature of the grinding surface 38. This should preferably include a plurality of bars 48, and intervening grooves, recesses, or cut-outs 54, such as shown with individual bars 48*a, b, c* and *d* and transverse connecting web structure 49 for grinding plate 36A in FIGS. 6 and 7. These bars and grooves are spaced apart in the width dimension of the plate, and extend parallel to the hammermill axis 18. FIG. 1 shows the front end 50 of plate 36A, which is adjacent the discharge opening 58 in the discharge end 16 of the casing. The other end 52 of plate 36A is adjacent the inlet end 14 of the casing, as shown in FIG. 5.

Figure 6:
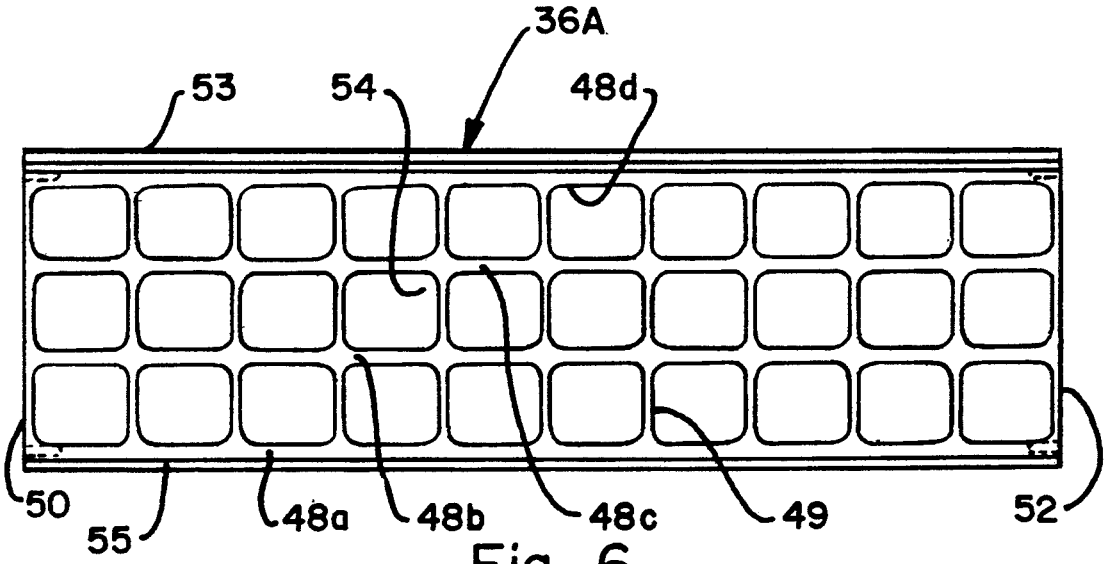
FIG. 6 is a plan view of one of the breaker bar plates of the grinding surface at the bottom of the hammermill.
Figure 7:
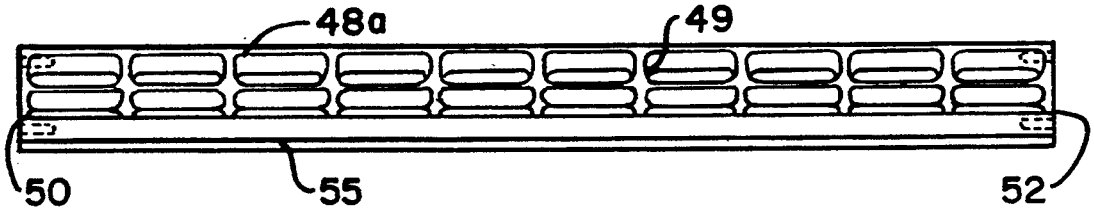
FIG. 7 is an elevation view of the plate of FIG. 6.

As shown in FIG. 4, the grinding surface 38 is formed by two adjacent grinding plates 36A,36B, situated at the bottom of the side wall 20, symmetrically about a vertical plane passing through the axis 18. Flanges 53,55 at the sides of the plates such as shown in FIG. 6, may be provided for securing the plates in place and permitting easy removal and replacement thereof during periodic servicing of the hammermill. FIG. 4 shows a fixturing means 59 which has shoulders overlapping the flanges along their length dimension.

The rotor assembly 26 as best shown in FIGS. 4 and 5, includes a first plurality of hammer elements 32 axially spaced apart perpendicularly to the shaft 28, with each hammer element tip 34 having a thickness parallel to the axis (as seen in FIG. 5), that is small relative to the length and width dimensions of the element (as seen in FIG. 4). The support means include a plurality of discs such as 30A,30B, attached in axially spaced apart relation on the shaft 28, with a plurality of support rods 62 which span the discs in parallel with the axis. A plurality, preferably at least four hammer elements 32 are located between successive discs 30A,30B. The sum of the thicknesses of the total number of hammer elements between successive discs 30A,30B, can be nearly equal to the distance between the successive discs. Because at least some of the hammers are located at different axial positions, and thus each has its own "track" of rotation, most of the grinding surface 38, as viewed in the length dimension L, will be directly beneath a rotating hammer tip 34.

It should also be appreciated that the hammer elements extend radially farther from the shaft 28, than the radial extent of the discs 30. Because the hammer elements are spaced at intervals around the shaft 18, as shown in FIG. 4, it would be possible for some of the material in the grinding zone to blow past the hammers on its way to the discharge opening 58. In another feature of the present invention, a plurality of divider elements 60 are provided at axially spaced apart locations along the plates 36A,36B. The divider elements extend substantially annularly, between the grinding surface 38 and the hammer element support discs 30. As shown in FIG. 4, the divider elements 60 also extend in an arc $A_2$ that is greater than the arc $A_1$ spanned by the grinding surface 38. Preferably, each divider element is radially aligned with a respective disc 30, as shown in FIG. 5. In this way, divider element 60A radially aligns with disc 30A, divider element 60B radially aligns with disc 30B, etc.

The divider elements 60 preferably are spaced slightly at their radially outer edge from the grinding surface 38, e.g., by about 0.06 inch (0.15 cm). The elements 60 are supported at their ends by the sidewall 20 near regions 42 and 44, and are supported on either side of the grinding plates 36A,36B by fixture means 59A,59B.

The presence of the divider elements 60 create a plurality of "mini grinding zones" where grinding is highly intensive. The dividers 60 eliminate void spots in the grinding zone by occupying a portion of the grinding surface of the plates such as 36A, which are not in a hammer track. This therefore increases the proportion of the grinding surface which particles can occupy and which are in a hammer track. The dividers could thus occupy up to about 20% of the surface area of the grinding surface 38. In general, the proportion of the distance occupied by the discs 30, would be about one half of the total axial extent of the hammer-bearing portion of the rotor assembly 26, if, as is preferred, the thickness of each divider element 60 in the axial direction, is approximately one half the thickness of each disc 30 in the axial direction.

FIGS. 1,4, and 5 show a further feature of the invention, whereby the side wall 20, and in particular the gap clearance at 40 between the hammer tip effective diameter D and the grinding surface 38, can be adjusted. The side wall 20 may consist of several pieces joined together, but the side wall 20 is as a practical matter, a unitary member which, along with the divider plates 60, can be raised or lowered by the clearance adjustment mechanism 64 at the top of the hammermill. The adjustment mechanism as illustrated includes components 66,68, and 70 at the upper portions of the axial ends of the casing 12, a support bar 72 between them, and an adjustment actuator 70. Any manual or automatic adjustment configuration may be used with the invention, with that illustrated herein being of relatively simple and straightforward design. Bosses 66 are directly attached to the upper end of the side wall 20, below the support bar 72, and a threaded nut or the like is situated above boss 66, on the upper side of bar 72. A threaded rod 74 traverses the nut 68, support bar 72 and nut 68. The handle 70 and associated worm gear pass through nuts 68 into engagement with the threads on rods 74. In this manner, as the handle 70 is rotated, the rod 74 moves upwardly or downwardly, thereby lifting or lowering the side wall 20 through the connection at 66.

It may also be appreciated that as shown in FIGS. 1–3, the inlet and discharge ends 14,16 may have associated with their external surfaces, respective reinforcement and bearing members 76,78, for supporting the shaft 28. The discharge end 16 may also have a window or the like as shown at 82 in FIG. 1, for selective viewing of the discharge. In a conventional manner, the hammermill would, in operation, be secured onto a base 80 or the like (see FIG. 2), and connected to various other components such as a drive motor, material conveying means, etc. (not shown).

Such conveying means would deliver a supply of shelled corn material through inlet opening 56 at the inlet end 14, well above the axis 18 of the hammermill. As shown in FIG. 4, the inlet opening 56 can be in the shape of a quadrant of an annulus. In the illustrated embodiment, the hammer element effective tip diameter D lies between the inner and outer boundaries 84, 86 of the opening, but this is not necessary. As shown in FIG. 5, the material enters at the right and is thereupon impacted by the rotating hammer elements 32. The combination of pneumatic pressure differential between the inlet opening 56 and the discharge opening 58, as well as the windage generated by the rotating assembly 26, imparts a generally helical flow path to the particulates as they travel axially from the inlet opening 56 to the discharge opening 58. This helical path is enhanced by the presence of the divider elements 60.

It should be appreciated upon inspection of FIG. 4, that material moving at a relatively low velocity in most of the space 24, is reduced in size upon impact from the hammer elements 32 which rotate clockwise. As a particular volume of material is advanced into the grinding zone at the grinding surface 38, the material is forced against the right side edges of the breaker bars 48, which run transversely to the direction of rotation of the hammer elements. These edges act as flow diverters which cause the material to repeatedly re-enter the diameter D along arc $A_1$. In the illustrated embodiment, plates 36A,36B are reversible within the side wall 20, and each presents four breaker bar edges for interaction with the hammer elements. It is contemplated that between four and sixteen bars could be provided on each plate section. Furthermore, the rotor direction can be reversed so that the hammer tips 34 cross the bars in a counterclockwise movement, thereby interacting with the left side edges of the bars.

The tips 34 of the hammer elements preferably are notched, thereby defining at least four edges. With two notches as shown at 34 in FIG. 4, a total of six edges are defined, i.e., three usable edges for each of the clockwise and counterclockwise directions of rotation. The curvature of the tips is centered about the respective support rods 62, so that if a hammer element "rocks" a uniform clearance to guiding surface 38 is maintained.

The interaction of the multiple edges of each hammer element tip 34 with the multiple edges on the bars 48 of the plates 36A,36B produces a certain number of "impacts" or "pulses" per second or per inch of hammer element travel, as experienced by a given volume of material. This provides a design and operating parameter which can be correlated to the desired fineness of the grind.

The invention as described above, provides considerable improvement over conventional hammermills of the type used for the size reduction of grain and other friable material, primarily because of the elimination of the screen, and the associated simplification of the casing. The characteristics of the hammermill can be adjusted either manually or through an automated procedure, by merely lifting the side walls to influence the clearance in the grinding gap between the grinding plates and the hammer element effective tip diameter. If a greater difference in optimization is desirable, the breaker plates can be easily replaced to provide a different number or spacing of the breaker bars.

I claim:

1. A hammermill comprising:

a casing having an inlet end, a discharge end, a longitudinal axis passing between the inlet and discharge ends, and a sidewall substantially encapsulating the axis between the inlet and discharge ends, such that an enclosed grinding space is defined within the casing;

a rotor assembly situated within the casing for rotation about the axis, and including a rotatable shaft on the axis, support means extending radially from the shaft for co-rotation therewith, and hammer elements attached to the support means, the hammer elements each having a radially outer tip which defines a hammer rotation diameter;

at least one grinding plate at the inside of the sidewall for defining a grinding surface in the grinding space having a radius of curvature centered on the axis, a length dimension parallel to the axis, and a width dimension defined by an arc $A_1$ of less than about 90 degrees about the axis, the grinding plate being arranged such that each hammer tip passes along the width dimension of the grinding plate with a clearance in the range of about 0.30 to 1.50 inch defining a grinding gap;

wherein the sidewall other than at the grinding plate has a non-uniform curvature which defines a non-uniform clearance from the hammer rotation diameter that is greater than the grinding gap clearance, said non-uniform curvature including at least one sidewall portion having a radius of curvature less than that of the grinding surface.

2. The hammermill of claim 1, wherein the grinding plate has a plurality of bars, that are spaced apart in the width dimension and extend parallel to the axis.

3. The hammermill of claim 1, wherein the grinding surface is formed by two adjacent grinding plates, situated at the bottom of the sidewall.

4. The hammermill of claim 1, wherein the sidewall below the elevation of the axis includes the grinding surface and a first and second lobed regions on each side of the grinding surface, each lobed region having the greatest clearance but the smallest radius of curvature in the sidewall below the elevation of the axis.

5. The hammermill of claim 1, wherein an inlet opening to the grinding space is provided at the inlet end above the elevation of the axis; and a discharge opening is provided at the discharge end below the elevation of the axis.

6. The hammermill of claim 1, wherein the sidewall in diametral opposition to the grinding surface defines a lobed region having the largest clearance of any portion of the sidewall.

7. The hammermill of claim 1, wherein the rotor assembly includes a first plurality of hammer elements axially spaced apart along the shaft; and a second plurality of divider elements are provided at axially spaced apart locations between axially spaced hammer elements, the divider elements extending substantially annularly between the grinding surface and the hammer element support means.

8. The hammermill of claim 1, wherein the divider elements extend in an arc $A_2$ that is greater than the arc $A_1$ spanned by the grinding surface.

9. The hammermill of claim 1 wherein the support means include a plurality of discs attached in axially spaced apart relation to the shaft;

the hammer rotation diameter is greater than the diameter of the discs; and a plurality of substantially annular divider elements are provided at axially spaced apart locations in substantial radial alignment with respective discs, the divider elements extending radially substantially from the discs to the grinding surface and spanning an arc $A_2$ that includes the arc $A_1$ spanned by the grinding surface.

10. The hammermill of claim 9, wherein the support means include a plurality of support rods which span the discs in parallel with the axis; and the plurality of hammer elements include at least one hammer element connected to each rod between each disc.

11. The hammermill of claim 10, wherein each hammer element tip has a thickness parallel to the axis, and the sum of the thicknesses of the total number of elements between successive discs, is greater than fifty percent of the distance between successive discs.

12. The hammermill of claim 11, wherein a total of at least four hammer elements 32 are provided between successive discs, each element being located at a different axial position.

13. The hammermill of claim 1, including means for adjusting the clearance of the grinding gap.

14. The hammermill of claim 13, wherein the means for adjusting, moves the grinding surface radially relative to the hammer rotation diameter.

15. The hammermill of claim 14, wherein the means for adjusting displaces the entire sidewall including grinding plate.

16. A screenless hammermill for reducing the size of friable material comprising:

a casing having an inlet end, a discharge end, a longitudinal axis passing between the inlet and discharge ends, and a sidewall substantially encapsulating the axis between the inlet and discharge ends, such that an enclosed grinding space is defined within the casing;

a rotor assembly situated within the casing for rotation about the axis, and including a rotatable shaft on the axis, support means extending radially from the shaft for co-rotation therewith, and hammer elements attached to the support means, the hammer elements each having a radially outer tip which defines a hammer rotation diameter;

at least one grinding plate at the inside of the sidewall for defining a grinding surface in the grinding space having a radius of curvature centered on the axis, a length dimension parallel to the axis, and a width dimension defined by an arc $A_1$ of less than about 90 degrees about the axis, the grinding plate having a plurality of bars defining edges that are spaced apart in the width dimension and extend parallel to the axis such that each hammer tip passes along the width dimension of the grinding plate with a clearance from the bars that defines a grinding gap;

first means, at the inlet end, for introducing said material in said conveying air stream into the casing;

second means, at the outlet end, for removing ground material in a conveying air stream from the discharge end;

whereby the material is influenced in the casing by said rotor assembly and said conveying air stream, to follow a substantially helical flow path about said axis such that the material is intermittently reduced in size in a succession of axially spaced passes through said grinding gap,

17. The hammermill of claim 16, wherein the sidewall other than at the grinding plate has a non-uniform curvature which defines a non-uniform clearance from the hammer rotation diameter that is greater than the grinding gap clearance, said non-uniform curvature including at least one sidewall portion having a radius of curvature less than that of the grinding surface.

18. The hammermill of claim 16, wherein each hammer tip has at least four edges oriented in parallel with the edges on the bars.

19. The hammermill of claim 16, wherein the rotor assembly includes a first plurality of hammer elements axially spaced apart along the shaft; and a second plurality of divider elements are provided at axially spaced apart locations between axially spaced hammer elements, the divider elements extending substantially annularly between the grinding surface and the hammer element support means.

20. The hammermill of claim 16, wherein the support means include a plurality of discs attached in axially spaced apart relation to the shaft;

the hammer rotation diameter is greater than the diameter of the discs; and a plurality of substantially annular divider elements are provided at axially spaced apart locations in substantial radial alignment with respective discs, the divider elements extending radially substantially from the discs to the grinding surface and spanning an arc $A_2$ that includes the arc $A_1$ spanned by the grinding surface.

21. A hammermill comprising:

a casing having an inlet end, a discharge end, a longitudinal axis passing between the inlet and discharge ends, and a sidewall substantially encapsulating the axis between the inlet and discharge ends, such that an enclosed grinding space is defined within the casing;

a rotor assembly situated within the casing for rotation about the axis, and including a rotatable shaft on the axis, support means extending radially from the shaft for co-rotation therewith, and hammer elements attached to the support means, the hammer elements each having a radially outer tip which defines a hammer rotation diameter;

at least one grinding plate at the inside of the sidewall for defining a grinding surface in the grinding space having a radius of curvature centered on the axis, a length dimension parallel to the axis, and a width dimension defined by an arc about the axis, the grinding plate having a plurality of spaced apart edges such that each hammer tip passes along the width dimension of the grinding plate with a clearance from the edges which defines a grinding gap;

wherein the sidewall other than at the grinding plate has a non-uniform curvature which defines a non-uniform clearance from the hammer rotation diameter that is greater than the grinding gap clearance, said non-uniform curvature including at least one sidewall portion having a radius of curvature less than that of the grinding surface.

22. The hammermill of claim 21, wherein the grinding plate has a plurality of bars that define said edges so as to be spaced apart in the width dimension and extend parallel to the axis.

23. The hammermill of claim 21, wherein said clearance is in the range of about 0.03 to 1.5 inch.

24. The hammermill of claim 23, including means for adjusting the clearance of the grinding gap.

25. A hammermill comprising:

a casing having an inlet end, a discharge end, a longitudinal axis passing between the inlet and discharge ends, and a sidewall substantially encapsulating the axis between the inlet and discharge ends, such that an enclosed grinding space is defined within the casing;

a rotor assembly situated within the casing for rotation about the axis, and including a rotatable shaft on the axis, support means extending radially from the shaft for co-rotation therewith, and hammer elements attached in axially spaced apart relation to the support means, the hammer elements each having a radially outer tip which defines a hammer rotation diameter;

a grinding surface at the inside of the sidewall defining a plurality of rigid edges projecting into the grinding space, the grinding surface having a length dimension parallel to the axis, and a width dimension defined by an arc $A_1$ transverse to the axis, the grinding surface being arranged such that each hammer tip passes along the width dimension of the grinding plate with a clearance from the edges in the range of about 0.30 to 1.50 inch, thereby defining a grinding gap;

wherein the sidewall other than at the grinding surface has a non-uniform curvature which defines a non-uniform clearance from the hammer rotation diameter that is greater than the grinding gap clearance.

* * * * *

UNITED STATES PATENT AND TRADEMARK OFFICE

CERTIFICATE OF CORRECTION

PATENT NO. : 5,364,038

DATED : November 15, 1994

INVENTOR(S) : Stanley R. Prew

It is certified that error appears in the above-indentified patent and that said Letters Patent is hereby corrected as shown below:

Column 7, line 51, "0.30" should read --0.03--.

Column 10, line 59, "0.30" should read --0.03--.

Signed and Sealed this

Twenty-fourth Day of December, 1996

*Attest:*

Bruce Lehman

BRUCE LEHMAN

*Attesting Officer*

*Commissioner of Patents and Trademarks*